US007442061B2

(12) United States Patent
Hirata et al.

(10) Patent No.: US 7,442,061 B2
(45) Date of Patent: Oct. 28, 2008

(54) CONNECTION DEVICE AND ELECTRONIC EQUIPMENT HAVING THE SAME

(75) Inventors: Kouji Hirata, Kato-gun (JP); Michihiro Fujii, Kato-gun (JP); Yoshito Fukata, Kato-gun (JP); Katsushige Kohri, Kato-gun (JP); Yoshiya Matsumoto, Kawasaki (JP)

(73) Assignees: Fujitsu Limited, Kawasaki (JP); NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 10/859,118

(22) Filed: Jun. 3, 2004

(65) Prior Publication Data

US 2004/0253859 A1 Dec. 16, 2004

(30) Foreign Application Priority Data

Jun. 13, 2003 (JP) ..... 2003-169820

(51) Int. Cl.
*H01R 13/53* (2006.01)

(52) U.S. Cl. ..... 439/181

(58) Field of Classification Search ..... 439/181, 439/101, 108, 608, 79
See application file for complete search history.

(56) References Cited

U.S. PATENT DOCUMENTS

| | | | | |
|---|---|---|---|---|
| 5,057,028 | A * | 10/1991 | Lemke et al. | 439/101 |
| 6,053,751 | A * | 4/2000 | Humphrey | 439/608 |
| 6,309,255 | B1 * | 10/2001 | Yu | 439/101 |
| 6,347,955 | B1 | 2/2002 | Huang | |
| 6,597,343 | B1 | 7/2003 | Akiyama et al. | |
| 6,764,315 | B2 * | 7/2004 | Ng et al. | 439/101 |

FOREIGN PATENT DOCUMENTS

| | | |
|---|---|---|
| JP | 2000-347790 | 12/2000 |
| JP | 3078521 | 4/2001 |

* cited by examiner

*Primary Examiner*—Felix O. Figueroa
(74) *Attorney, Agent, or Firm*—Kratz, Quintos & Hanson, LLP

(57) ABSTRACT

A connection device of electronic equipment which provides a connection device preventing electrostatic damage and electronic equipment provided with the connection device. The connection device includes conductive terminals and lightning conductor portions disposed adjacent to and insulated from the conductive terminals, the lightning conductor portions being kept at the grounding potential through connection to a grounded conductor, thus causing static electricity discharge in the lightning conductor portions and avoiding discharge toward the conductive terminals.

12 Claims, 8 Drawing Sheets

CONNECTION DEVICE AND ELECTRONIC EQUIPMENT HAVING THE SAME

BACKGROUND OF THE INVENTION

1. Field of the Invention

The present invention relates generally to a connection device disposed on a mobile phone, PHS (Personal Handyphone System) and other mobile information terminals for connection with external devices such as peripherals, and, more particularly, to antistatic measures for a connection device and electronic equipment having the connection device.

2. Description of the Related Art

Mobile phones are provided with connection devices such as charge terminals and USB (Universal Serial Bus) connection terminals. With such connection devices, charge terminals are connected to a charger for charging the built-in secondary battery, whereas USB connection terminals and others are connected to external equipment such as personal computer for exchanging information. Connection terminals provided on a mobile phone are exposed outside the case to facilitate connection with the charger or external equipment and are therefore subjected to an electrostatically charged environment such as human body.

Japanese Utility Model Registration No. 3078521 and Japanese Patent Application Laid-Open Publication No. 2000-347790 are among prior patent documents in relation to these connection devices and antistatic measures thereof.

Japanese Utility Model Registration No. 3078521 discloses, as a USB connector with upgraded grounding effect, one in which the connector's grounding effect has been upgraded by establishing electrical continuity between the metal case and the electrical conduction means through connection. Meanwhile, Japanese Patent Application Laid-Open Publication No. 2000-347790 relates to a keyboard apparatus and discloses, as a USB-compatible keyboard apparatus preventing defects caused by electrostatic noise such as malfunction and faulty operation, a construction in which a shield plate is provided covering the underside of the control circuit board and the shield plate is electrically connected to the USB connector's frame ground portion and to the shield wire of a cable connected to the personal computer ("PC") main body.

Incidentally, electrostatic discharge—resulting from static electricity from a human body, etc., acting on the USB and other connection terminals exposed on a mobile phone-leads to a high voltage being applied to the circuit board side of the mobile phone, possibly damaging the circuitry in the circuit board side or resulting in malfunction.

While the aforementioned patent documents present the problem in respect of electrostatic countermeasures, they are not designed to ensure electrostatic damage prevention or lightning protection for connection devices used for external connection.

SUMMARY OF THE INVENTION

It is an object of the present invention to prevent electrostatic damage to the connection device.

It is another object of the present invention to prevent electrostatic damage to electronic equipment provided with the connection device.

To achieve the above objects, the connection device of the present invention comprises conductive terminals and lightning conductor portions provided adjacent to and insulated from the conductive terminals and maintained at the grounding potential through connection to a grounded conductor.

If the connection device is exposed to an electrostatically charged environment such as human body, such a configuration allows static electricity to jump to the lightning conductor portions on the grounding potential side because the lightning conductor portions are provided adjacent to and insulated from the conductive terminals for external connection and maintained at the grounding potential through connection to a grounded conductor. That is, static electricity of the human body, etc., flows into the grounded conductor side through the lightning conductor portions, avoiding induction of static electricity into the conductive terminal side and protecting the circuit board and its mounted components from high voltage caused by static electricity.

To achieve the above objects, the lightning conductor portions may be configured such that their conductor surface is positioned higher than the terminal surfaces of the conductive terminals. Such a configuration brings each of the lightning conductor portions closer to the static electricity source such as human body than the conductive terminals, inducing static electricity into the lightning conductor portions and improving lightning protection effect for the conductive terminals.

To achieve the above objects, the lightning conductor portions may be configured such that their conductor surface is smaller in area than the terminal surfaces of the conductive terminals. It suffices even in such a configuration to provide the lightning conductor portions, maintained at the grounding potential, adjacent to the conductive terminals, providing lightning protection effect irrespective of the area thereof.

To achieve the above objects, each of the lightning conductor portions may be provided with one, two or more protrusions on the conductor surface. Such a configuration allows static electricity to readily jump to the protrusions, improving lightning protection effect for the conductive terminals.

To achieve the above objects, the electronic equipment of the present invention is provided with the aforementioned connection device. Such a configuration allows static electricity to jump to the lightning conductor portions, protecting the conductive terminals for external connection and preventing electrostatic damage to and malfunction of the electronic equipment.

Features and advantages of the present invention are listed below.

(1) According to the connection device of the present invention, it is possible to generate electrostatic discharge in the lightning conductor portions adjacent to the conductive terminals, thus avoiding electrostatic discharge to the conductive terminal side and protecting the circuit board and its electronic components connected to the conductive terminals from electrostatic damage.

(2) In the connection device of the present invention, positioning its conductor surface higher than the terminal surfaces of the conductive terminals facilitates electrostatic discharge on the lightning conductor portions, thus providing improved lightning protection effect.

(3) In the connection device of the present invention, reducing its conductor surface to be smaller in area than the terminal surfaces of the conductive terminals allows reducing the area occupied by the lightning conductor portions in the connection device while providing lightning protection effect.

(4) In the connection device of the present invention, providing one, two or more protrusions on the conductor surface of the lightning conductor portions allows static electricity to readily jump to the protrusions, improving lightning protection effect for the conductive terminals.

(5) According to the electronic equipment of the present invention, the connection device provided in the electronic equipment allows static electricity to jump to the lightning conductor portions, protecting the conductive terminals for external connection and preventing electrostatic damage to and malfunction of various electronic equipment such as mobile phone.

BRIEF DESCRIPTION OF THE DRAWINGS

Other objects, features and advantages of the present invention will become more apparent from the accompanying drawings and embodiments.

DETAILED DESCRIPTION OF THE PREFERRED EMBODIMENTS

Figure 1:
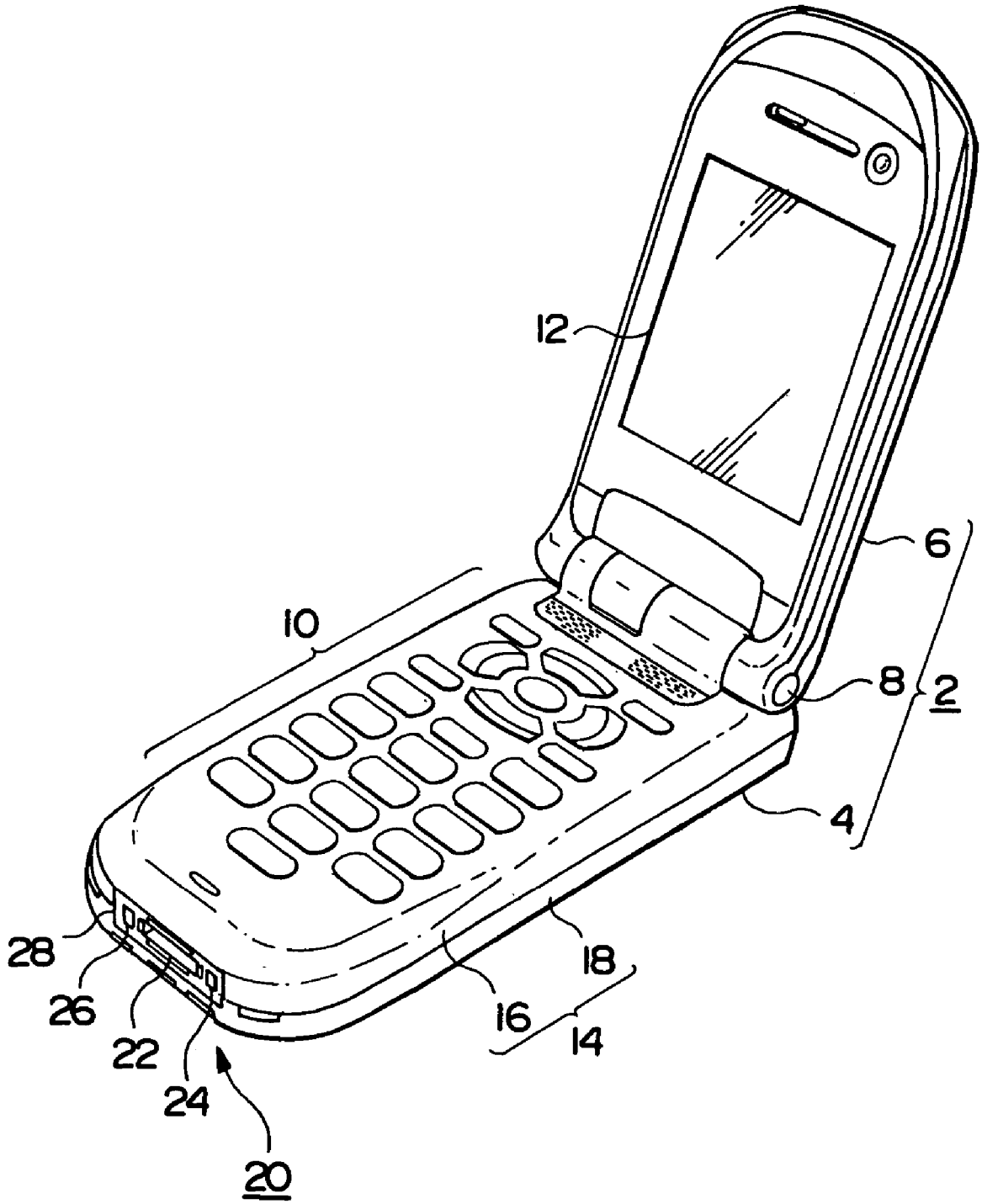
FIG. 1 is a perspective view of a mobile phone according to an embodiment of the present invention when it is open.
Figure 2:
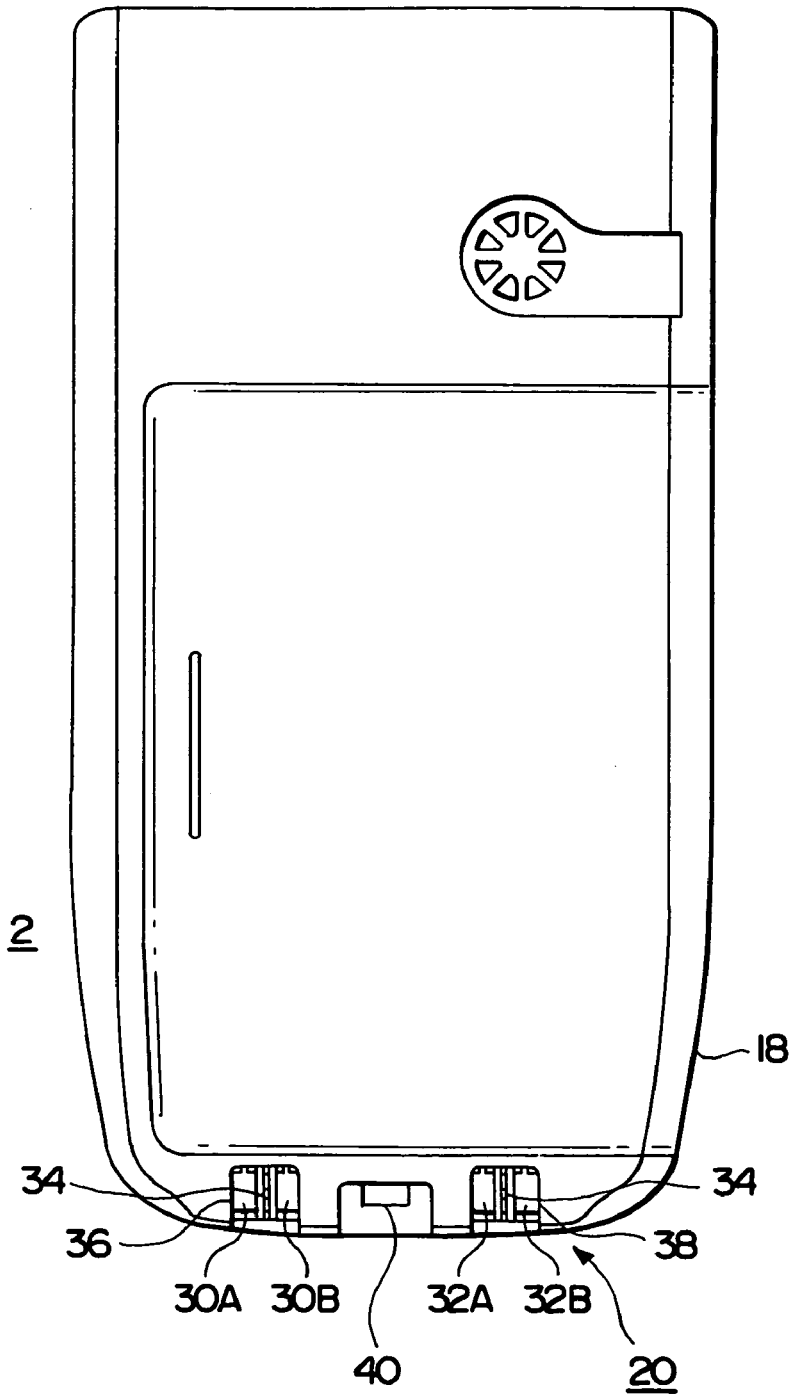
FIG. 2 is a rear side view of a control portion in which the connection device is provided.
Figure 3:
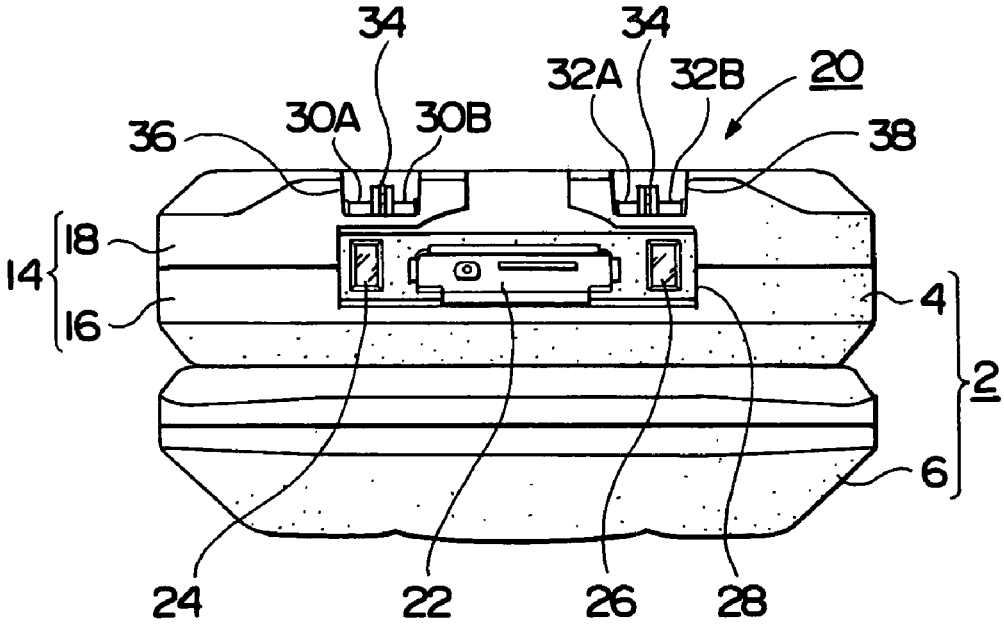
FIG. 3 is a view showing the appearance of the connection device provided in the control unit.

An embodiment of the connection device and electronic equipment of the present invention will be described with reference to FIGS. 1 to 3. FIG. 1 is a perspective view of a mobile phone according to the embodiment when it is open, FIG. 2 is a rear side view of a control unit of the mobile phone, and FIG. 3 is a view showing a connection unit of the control unit.

Having a fold-up structure, the mobile phone 2 is configured by a control unit 4 and a display unit 6 that are foldable by a hinge portion 8, with a plurality of key buttons 10 including character keys provided in the control unit 4 and a Liquid Crystal Display ("LCD") 12 provided in the display unit 6. A case 14 of the control unit 4 consists of a front case 16 and a rear case 18, and a molded body of synthetic resin is, for example, employed for the front and rear cases 16 and 18.

A connection device 20 according to the embodiment of the present invention is provided at the edge portion of the control unit 4, and a connector connection portion 22 is provided between charge terminals 24 and 26 in the connection device 20, with the connector connection portion 22 and the charge terminals 24 and 26 being exposed from a window portion 28 of the case 14.

The connection device 20 also has, as conductive terminals for external connection, USB terminals 30A, 30B, 32A and 32B arranged with spacings, with a lightning conductor portion 34 constituting a lightning arrester provided between the USB terminals 30A and 30B and another between the USB terminals 32A and 32B. On the rear case 18, window portions 36 and 38 are formed respectively in association with the USB terminals 30A and 30B and the lightning conductor portion 34 and the USB terminals 32A and 32B and the lightning conductor portion 34, with the USB terminals 30A and 30B and the lightning conductor portion 34 exposed on the window portion 36 and the USB terminals 32A and 32B and the lightning conductor portion 34 exposed on the window portion 38. Each of the window portions 36 and 38 is formed at the boundary portion between the rear surface portion and the end surface portion of the rear case 18, with the USB terminals 30A, 30B, 32A and 32B provided inside the window portions 36 and 38. The conductor surface of the top portion of each of the lightning conductor portions 34 projects outward more than the terminal surfaces of the USB terminals 30A, 30B, 32A and 32B and at the same time is located more backward on the inner surface side of the window portions 36 and 38 than the outer surface portion of the rear case 18. A recessed portion 40 formed within the spacing between the window portions 36 and 38 is used to lock the connector cap not shown to the case 14.

Figure 4:
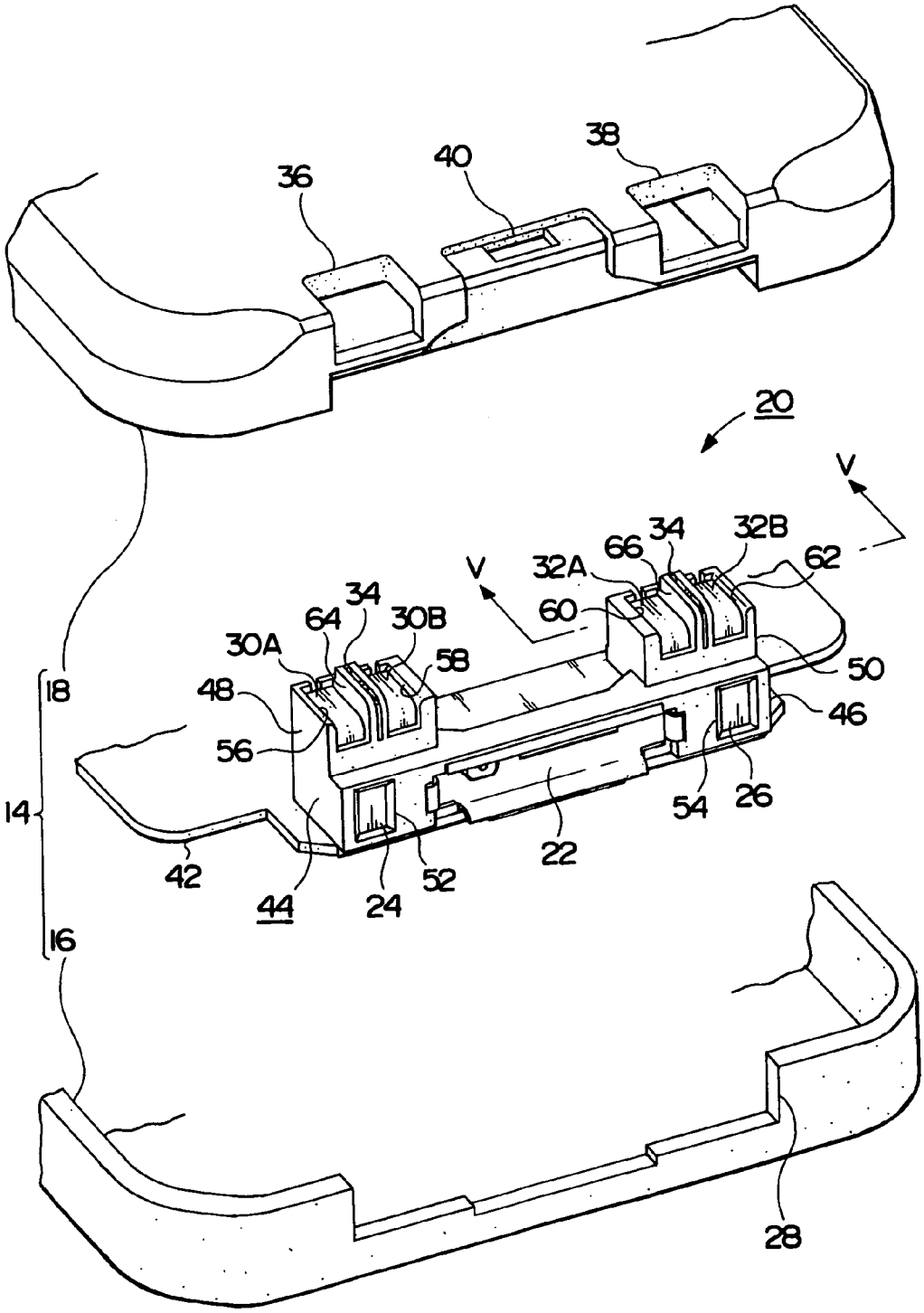
FIG. 4 is an exploded perspective view showing the connection device by disassembling the control unit.
Figure 5:
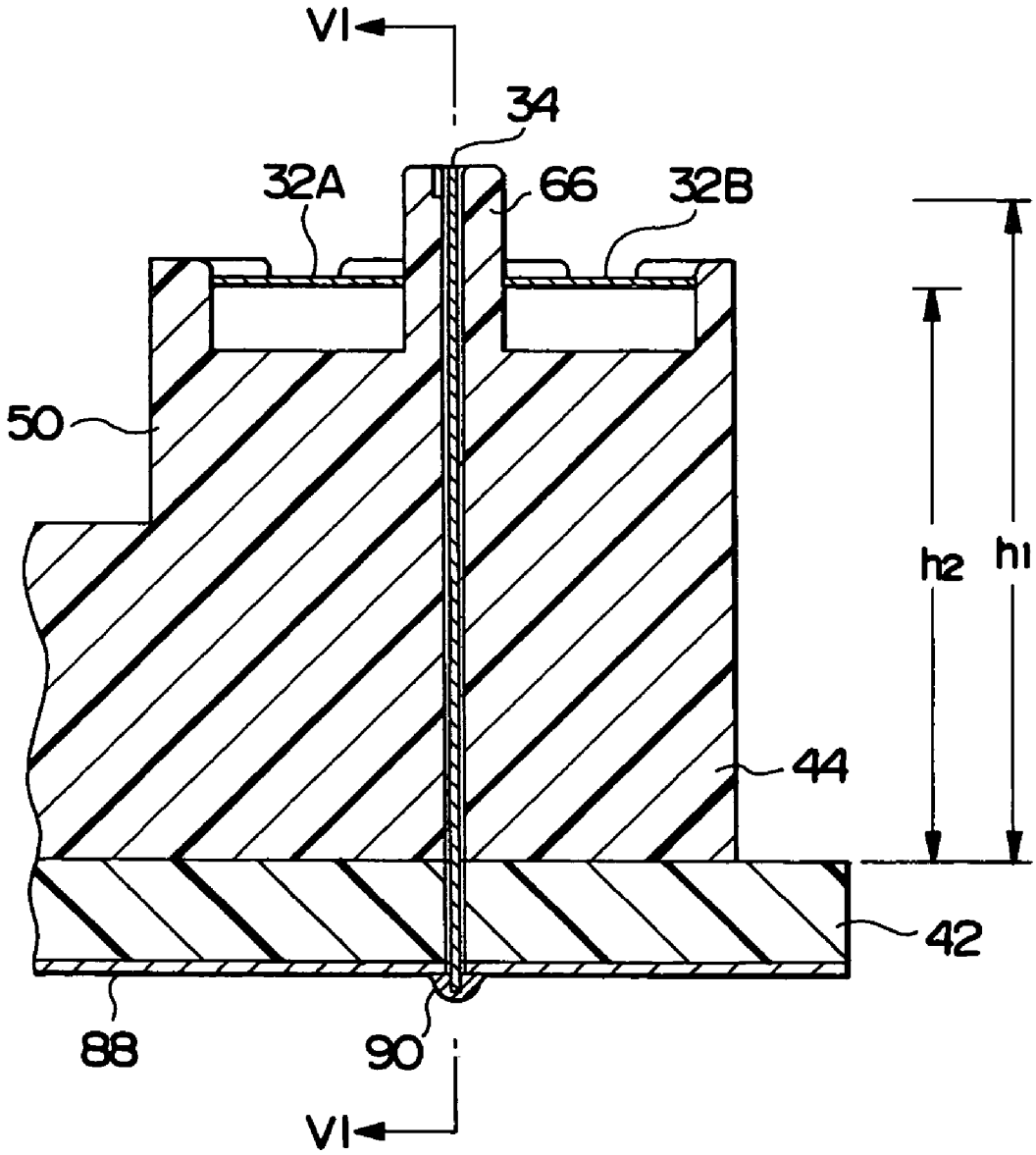
FIG. 5 is a sectional view of the connection device taken on line V-V of FIG. 4.
Figure 6:
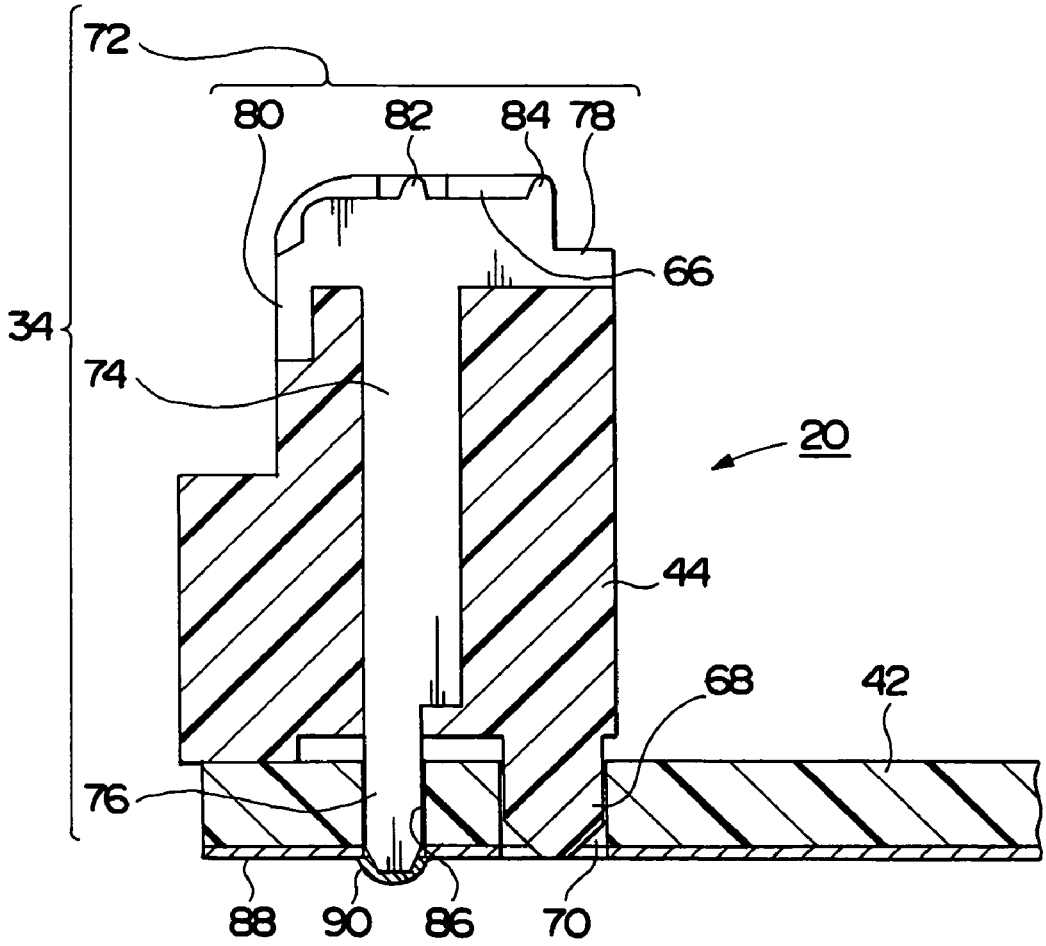
FIG. 6 is a sectional view of the connection device taken on line VI-VI of FIG. 5.

Next, the connection device 20 of the mobile phone 2 will be described with reference to FIGS. 4 to 6. FIG. 4 is a perspective view showing the connection device 20 extracted after disassembling the case 14, and FIG. 5 is a sectional view of the connection device taken on line V-V of FIG. 4.

The connection device 20, installed on a circuit board 42 incorporated in the case 14, is provided with an enclosure portion 44 formed with an insulating material such as synthetic resin. The enclosure portion 44 is provided with a protruding portion 46 that is inserted into the window portion 28 of the case 14 and also with protruding portions 48 and 50 that are inserted into the window portions 36 and 38 at its upper portion. A connector connection portion 22 is installed on the protruding portion 46, with the charge terminals 24 and 26 provided on each side of the connector connection portion 22. The flat terminal surfaces of the charge terminals 24 and 26 are provided within rectangular window portions 52 and 54 formed on the protruding portion 46.

On the protruding portions 48 and 50, there are formed opening portions 56 and 58 respectively in association with the USB terminals 30A and 30B, and there are formed opening portions 60 and 62 respectively in association with the USB terminals 32A and 32B. The opening portions 56, 58, 60 and 62 are open extending from the upper surface sides of the protruding portions 48 and 50 to the end surface side of the case 14, with a vertical wall portion 64 formed between the opening portions 56 and 58 for partitioning the opening portions 56 and 58 from each other and a vertical wall portion 66 formed between the opening portions 60 and 62 for partitioning the opening portions 60 and 62 from each other, and with the top portions of the vertical wall portions 64 and 66 curved on the end surface side of the case 14. The terminal surfaces of the USB terminals 30A, 30B, 32A and 32B are arranged extending from the upper surface side to the side surface side of the case 14 and in a curved manner in association with the opening shapes of the opening portions 56, 58, 60 and 62. The USB terminals 30A, 30B, 32A and 32B are connected to circuit conductors provided on the circuit board 42.

The lightning conductor portions 34 are individually supported by the vertical wall portions 64 and 66, with the conductor surfaces at the top portions of the lightning conductor portions 34 exposed at the top portions of the vertical wall portions 64 and 66. As shown in FIG. 5, therefore, a height $h_1$ of the conductor surfaces of the lightning conductor portions 34 relative to the circuit board 42 is higher than a height $h_2$ of the terminal surfaces of the USB terminals 30A, 30B, 32A and 32B and exposed on the opening surface sides of the window portions 36 and 38. For this reason, the lightning conductor portions 34 are located closer to the static electricity source such as human body than the terminal surfaces of the USB terminals 30A, 30B, 32A and 32B.

Next, the shape of the lightning conductor portions 34 will be described with reference to FIG. 6. FIG. 6 is a sectional view of the connection device 20 taken on line VI-VI of FIG. 5 by cutting through the connection device 20 at the vertical wall portion 66.

The enclosure portion 44 at which the lightning conductor portion 34 is grounded is formed with an insulator such as insulating synthetic resin and provided with a fitting protruding portion 68 at the bottom portion. As a result of fitting of the fitting protruding portion 68 into a fitting hole 70 of the circuit board 42, the enclosure portion 44 of the connection device 20 is positioned on and firmly secured to the circuit board 42.

The lightning conductor portions 34, formed with a conductor plate such as copper or brass plate, is provided with an exposed portion 72 that is supported by the vertical wall portion 66 of the enclosure portion 44 and whose conductor surface is exposed, an upright portion 74 that penetrates the enclosure portion 44 and a connection portion 76 that sticks out on the lower surface side of the enclosure portion 44 for connection with the circuit board 42. In the exposed portion 72, there are formed a projecting portion 78 that is exposed in association with the shape of the vertical wall portion 66 and a projecting portion 80 that is exposed in association with the front side of the vertical wall portion 66. At the top portion of the exposed portion 72, there are formed protruding portions 82 and 84 respectively at the rear edge and middle portions. The upright portion 74 is formed narrower than the exposed portion 72, whereas the connection portion 76 is formed thinner than the upright portion 74. Thus, the exposed portion 72 of the lightning conductor portion 34 spans from the rear portion to the front portion via the top portion, securing a wide conductor surface and facilitating or upgrading, thanks to the protruding portions 82 and 84, static electricity jumping to the exposed portion 72.

The lightning conductor portion 34 is supported by the enclosure portion 44 as a result of the upright portion 74 penetrating through the vertical wall portion 66 that is an insulator. The connection portion 76 of the lightning conductor portion 34 penetrates to a penetration hole 86 of the circuit board 42, with a frame ground 88, a grounded conductor, electrically connected via a solder 90 to the connection portion 76 sticking out on the rear side of the circuit board 42. Thus, the lightning conductor portion 34 is coated on the side surface portion with the vertical wall portion 66, an insulator, providing insulation from the adjacent USB terminals 32A and 32B and maintaining the portion 34 at the same potential as the frame ground 88 of the circuit board 42 through connection to the frame ground 88 via the connection portion 76. The same configuration is applied to the lightning conductor portion 34 on the side of the vertical wall portion 64.

Figure 7:
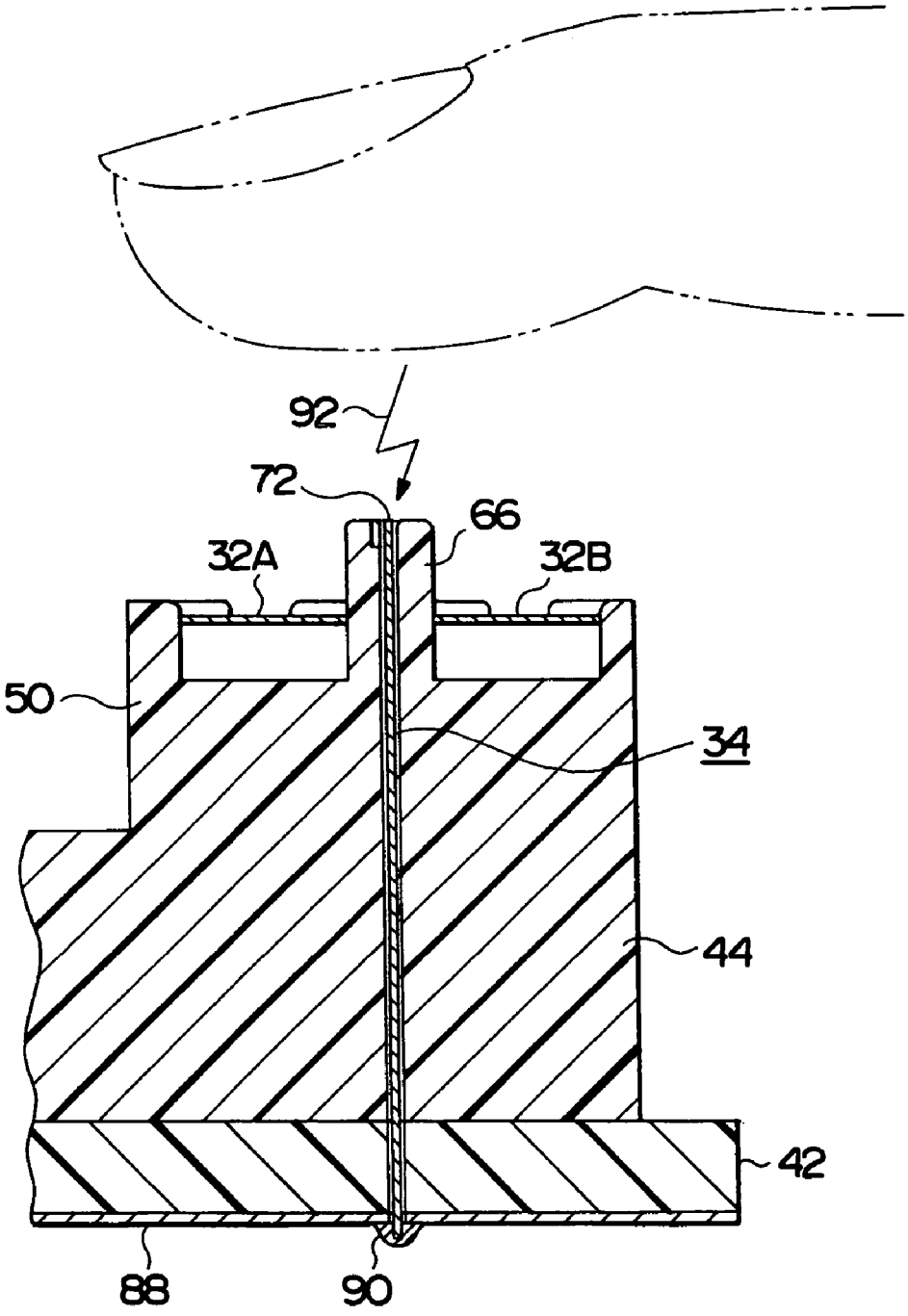
FIG. 7 is a view showing electrostatic discharge.
Figure 8:
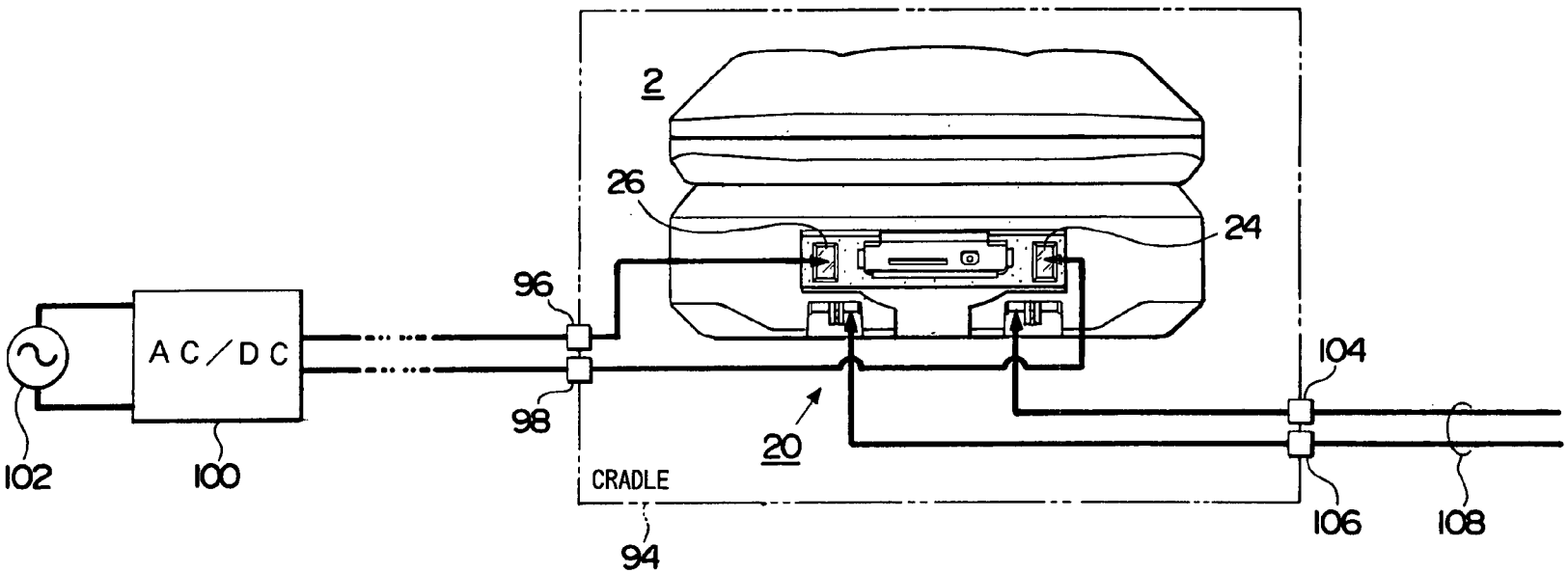
FIG. 8 is a view showing external connection of the mobile phone.

According to the configuration, if the mobile phone 2 is placed near the static electricity source such as human body, and for example, if part of the electrostatically charged human body is brought close to the USB terminals 32A and 32B, static electricity jumps to the exposed portions 72 of the lightning conductor portions 34 because the lightning conductor portions 34 provided near the USB terminals 32A and 32B are maintained at the grounding potential, thus causing static electricity, i.e., charge to flow into the frame ground 88 of the circuit board 42 via the upright portion 74 and the connection portion 76. In FIG. 7, 92 indicates electrostatic discharge. In this case, the conductor surface formed by the exposed portion 72 of the lightning conductor portion 34 is more elevated and larger in area than the USB terminals 32A and 32B, causing electrostatic discharge to jump to the side of the lightning conductor portion 34, allowing the lightning conductor portion 34 to form a lightning protection barrier on the side of the USB terminals 32A and 32B and eventually avoiding electrostatic discharge to the USB terminals 32A and 32B. Such a lightning protection effect ensures avoiding electrostatic discharge similarly on the side of the USB terminals 30A and 30B thanks to the lightning conductor portion 34. This protects the circuit conductors and electronic components of the circuit board 42 connected to the USB terminals 30A, 30B, 32A and 32B from electrostatic discharge, preventing electrostatic damage to the circuit board 42 and internal circuitry of the mobile phone 2 and their malfunction.

The lightning conductor portion 34 is provided adjacent to the USB terminals 30A and 30B or 32A and 32B, and in the case of the embodiment, provided between the USB terminals 30A and 30B or 32A and 32B, forming a grounding barrier on the USB terminals 30A and 30B or 32A and 32B and providing, through an extremely simple structure, lightning protection capability.

In the case of the present mobile phone 2, the built-in secondary battery is charged by installing the mobile phone 2 to a cradle 94 for charging and external connection, connecting an AC/DC converter 100 to the charge terminals 24 and 26 of the connection device 20 via connection terminals 96 and 98 of the cradle 94 and applying DC output obtained by rectifying AC current from an AC power supply 102. On the other hand, peripheral equipment such as personal computer (not shown) is connected to the USB terminals 30A, 30B, 32A and 32B of the connection device 20 via a USB cable 108 connected to connection terminals 104 and 106 of the cradle 94, thus enabling information exchange between the mobile phone 2 and external equipment. In this case, the lightning conductor portion 34 is grounded, making it possible to avoid electrostatic discharge to the USB terminals 30A, 30B, 32A and 32B during use.

Next, modifications and other technical extensions of the embodiment of the aforementioned connection device and electronic equipment will be listed below.

(1) While the above embodiment was described with reference to a mobile phone, the connection device and electronic equipment of the present invention include mobile phone, PHS, PDA (Personal Digital Assistant), PC (Personal Computer), handheld PC (handheld Personal Computer) and other mobile information terminals, and the present invention is applicable to connection devices and electronic equipment including digital camera having conductive terminals such as USB terminals and are not limited to the mobile phone of the embodiment.

(2) While the above embodiment was described with reference to USB terminals, the present invention is applicable to connection devices having conductive terminals other than USB terminals and is not limited to USB terminals.

(3) While the above embodiment was described with reference to the case in which the case 14 is a joined body of the front and rear cases 16 and 18, the case may be configured by a single case with a cover portion.

While a description was given, as described above, of the most preferred embodiments of the present invention, the present invention is not limited thereto and may, needless to say, be modified or changed variously by those skilled in the art based on the concept of the present invention described in the appended claims and disclosed in the detailed description of the present invention, and, of course, it includes such a modification or change.

The entire disclosure of Japanese Patent Application No. 2003-169820 including specification, claims, drawings and summary are incorporated herein by reference.

What is claimed is:

1. A connection device comprising:

at least two conductive terminals for external connection, the terminals being deployed along a side-by-side direction;

a lightning conductor disposed between the conductive terminals in the side-by-side direction, the lightning conductor being kept at a ground potential through connection to a grounded conductor to induce static electricity; and an insulating enclosure, formed of an insulating material and having the two conductive terminals and the lightning conductor thereon, wherein the enclosure includes a first portion protruding from and extending outside the enclosure and a second portion protruding from and extending outside the enclosure, the second portion constituting a vertical wall portion protruding higher than the first portion in a first direction perpendicular to the side-by-side direction, the first portion and the vertical wall being adjacent to each conductive terminal, and the lightning conductor being inside the vertical wall except for an exposed portion exposed at an edge of the vertical wall, and wherein side surfaces of the lightning conductor are covered with the vertical wall, the exposed portion of the lighting conductor and an exposed surface of the adjacent conductive terminal are at different heights in the first direction perpendicular to the side-by-side direction, and electrostatic discharge at the conductive terminals is avoided by inducing static electricity in the exposed portion of the lightning conductor wherein the lightning conductor inside the vertical wall does not extend beyond the vertical wall along the first direction perpendicular to the side-by-side direction.

2. A connection device according to claim 1, wherein the exposed portion of the lightning conductor is positioned laterally beyond the terminal surface of the conductive terminal along a second direction perpendicular to the first side-by-side direction.

3. A connection device according to claim 1, wherein the exposed portion of the lightning conductor portion is smaller in area than said terminal surface of the conductive terminal.

4. A connection device according to claim 1, wherein the exposed portion of the lightning conductor portion is provided with one or a plurality of protrusions.

5. A connection device according to claim 1, wherein the lightning conductor inside the vertical wall is supported, on both sides thereof, by inside portions of the vertical wall.

6. A connection device according to claim 5, wherein the lightning conductor is supported, on both by the inside portions of the vertical wall, continuously between the exposed portion and the grounded conductor.

7. Electronic equipment comprising:

at least two conductive terminals for external connection, the terminals being deployed along a side-by-side direction;

a lighting conductor disposed between the conductive terminals in the side-by-side direction, the lightning conductor portion being kept at a ground potential through connection to a grounded conductor to induce static electricity; and an insulating enclosure, formed of an insulating material and having the two conductive terminals and the lightning conductor thereon, wherein the enclosure includes a first portion protruding from and extending outside the enclosure and a second portion protruding from and extending outside the enclosure, the second portion constituting a vertical wall protruding higher than the first portion in a first direction perpendicular to the side-by-side direction, the first portion and the vertical wall being adjacent to each conductive terminal, and the lightning conductor being inside the vertical wall except for an exposed portion exposed at an edge of the vertical wall, and wherein side surfaces of the lightning conductor are covered with the vertical wall, the exposed portion of the lighting conductor and an exposed surface of the adjacent conductive terminal are at different heights in the first direction perpendicular to the side-by-side direction, and electrostatic discharge at the conductive terminals is avoided by inducing static electricity in the exposed portion of the lightning conductor wherein the lightning conductor inside the vertical wall does not extend beyond the vertical wall along the first direction perpendicular to the side-by-side direction.

8. Electronic equipment according to claim 7, wherein the exposed portion of the lightning conductor is positioned laterally beyond the terminal surface of the conductive terminal along a second direction perpendicular to the first side-by-side direction.

9. Electronic equipment according to claim 7, wherein the exposed portion of the lightning conductor portion is smaller in area than said terminal surface of the conductive terminal.

10. Electronic equipment according to claim 7, wherein the exposed portion of the lightning conductor portion is provided with one or a plurality of protrusions.

11. Electronic equipment according to claim 7, wherein the lightning conductor inside the vertical wall is supported, on both sides thereof, by inside portions of the vertical wall.

12. Electronic equipment according to claim 11, wherein the lightning conductor is supported, on both by the inside portions of the vertical wall, continuously between the exposed portion and the grounded conductor.

* * * * *